United States Patent [19]

Solomon et al.

[11] Patent Number: 4,536,016

[45] Date of Patent: Aug. 20, 1985

[54] BANKNOTES AND THE LIKE

[76] Inventors: David H. Solomon, 31 Brazilia Dr., Glen Waverley, Victoria 3150; John B. Ross, 6 Wandeen Rd., Glen Iris, Victoria 3146; Mario Girolamo, 50 Alpha Rd., North Balwyn, Victoria 3104; Robert A. Brett, 32 McLaren St., Mount Waverley, Victoria 3149, all of Australia

[21] Appl. No.: 499,753

[22] PCT Filed: Aug. 24, 1982

[86] PCT No.: PCT/AU82/00135

§ 371 Date: Apr. 25, 1983

§ 102(e) Date: Apr. 25, 1983

[87] PCT Pub. No.: WO83/00659

PCT Pub. Date: Mar. 3, 1983

[30] Foreign Application Priority Data

Aug. 24, 1981 [AU] Australia ..... PF0383

[51] Int. Cl.[3] ..... B42D 15/00; B42F 13/00; B42F 5/00; B65D 19/04

[52] U.S. Cl. ..... 283/111; 402/80 P; 206/387; 40/405

[58] Field of Search ..... 283/107, 109, 110, 111; 156/290, 292, 308.6, 295, 309.3; 428/200, 347, 354

[56] References Cited

U.S. PATENT DOCUMENTS

| | | | |
|---|---|---|---|
| 2,395,804 | 3/1946 | Gruchy | 283/110 |
| 3,245,697 | 4/1966 | Nugent | 283/111 |
| 3,694,285 | 9/1972 | Appel et al. | 283/107 |
| 3,950,013 | 4/1976 | Tagliaferri | 283/111 |
| 4,186,943 | 2/1980 | Lee | 283/107 |

FOREIGN PATENT DOCUMENTS

| | | | |
|---|---|---|---|
| 0013021 | 7/1980 | European Pat. Off. | 283/111 |

*Primary Examiner*—Paul A. Bell
*Assistant Examiner*—Paul M. Heyrana, Sr.
*Attorney, Agent, or Firm*—Sughrue, Mion, Zinn, Macpeak & Seas

[57] ABSTRACT

A security token, such as a bank note or identity card, comprises a sheet-like substrate made up from film of transparent bi-axially oriented polymer coated with layers of opaque and heat activated adhesive material. The opaque layer is applied in such a way as to leave a transparent area for inspection of a security device, for example, a diffraction grating, incorporated in the polymer film. The substrate may bear printed or other identifying indicia and is protected with an intimately bonded layer of transparent polymeric material.

12 Claims, 3 Drawing Figures

BANKNOTES AND THE LIKE

TECHNICAL FIELD

This invention relates to the design, construction and production of paper-like "security tokens" such as bank-notes, travellers cheques, share script, personal identification papers and the like. It seeks to provide a durable token of high security, that is, one which is most difficult to forge.

BACKGROUND ART

In our prior Australian Pat. No. 488,652, a novel approach to the production of security tokens—particularly bank-notes—was disclosed and the serious problems which confront conventional bank notes with respect to forgery were described. The security token or bank-note disclosed in Patent No. 488,652 comprised a substrate of opaque thermoplastic sheet material intimately bonded to a web of woven or unwoven thermoplastic fibres, the substrate being printed as desired and having bonded thereon one or more optically-variable security devices. The fibrous web was employed to impart durability, crumple-resistance and tear-strength to the note. Where a security device (such as a Moire pattern) was employed which depended for its optically variable properties upon the transmission of light, it was necessary to punch out a hole in the substrate, insert the device and bond it in place with further layers of (transparent) plastic sheet material.

Although samples of bank-notes formed in this way performed most satisfactorily with respect to conventional notes regarding durability and security, they were complex and relatively expensive. Moreover, when transmission security devices were inserted in pockets in the substrate, an area of weakness and high stress was created which reduced both durability and security.

DISCLOSURE OF THE INVENTION

It has now been found that tokens such as bank-notes can be produced with the durability and security of those described in our prior patent No. 488,652 without the complication and expense of the central fibrous web and without necessitating the damaging discontinuity previously required when transmission security tokens were employed.

It will be appreciated that the vulnerability of conventional bank-notes to forging has come about because of the great advances which have been made in the technologies of paper-making, printing and photo-engraving. The approach to this problem adopted by the present invention, like that of our Australian Pat. No. 488,652, is based upon the difficulty of simulating optically-variable devices by photo-engraving techniques.

In this specification, the term "optically-variable" means having an appearance which changes reversibly with a change in viewing conditions, for example, with change in viewing angle or with change in temperature or pressure.

Accordingly, the bank-note (or other security token) of the present invention comprises a flexible film bearing printed or other identifying indicia and at least one optically-variable security device, characterised in that the substrate comprises a transparent, bi-axially-oriented polymeric film composite having a heat-activated adhesive coating and an opacifying coating and characterised in that said substrate, indicia and optically variable device are covered with a transparent protective layer of polymeric material intimately bonded to the substrate.

The substrate may comprise a laminate of two or more layers of transparent bi-axially-oriented polymer film, each of which is coated on both sides with a heat activated adhesive layer. Alternatively, the substrate could be a suitable single-layer film should such become available in commercial quantities. Preferably, this substrate is coated on both sides with an opacifying pigmentary coating, comprising a major portion of pigment in a minor proportion of a cross-linked polymeric binder, the coating being applied so as to leave at least one transparent area within the film within which the optically variable device may be placed. It is also preferable to hot-stamp the optically variable device in position on the composite substrate, to print both sides of the substrate and to cover both sides with a transparent protective layer, all the components of the bank-note or other security token thus formed being intimately bonded together. (It is possible, of course, to apply the device before or after printing).

The use of optically variable devices in the note or security token within transparent areas allows them to be viewed from either side of the note or token and allows optical-transmission effects—such as Moire gratings—to be employed. Optically variable devices comprising Moire patterns and diffraction gratings were described in our above-mentioned prior Australian patent.

The invention also comprises a method of producing a bank-note or the like security token comprising the basic steps of forming a composite, transparent, polymeric substrate by heat-laminating at least two films of adhesive-coated, bi-axially-oriented polymer material together and by coating at least one surface of the composite sheet with an opacifying treatment including a major proportion of one or more pigmentary materials bound with a minor proportion of a heat-activated cross-linkable polymeric binder, passing said substrate through a printing machine to print indicia on said opacifying coating, hotstamping at least one optically variable device onto the substrate (either before or after printing, but preferably after) and then coating both sides of the printed substrate with a transparent protective layer of polymer material.

In order to minimise the discontinuity associated with the inclusion of a security device within the bank-note or the like token, the substrate is typically between 60 and 80 microns thick, while the optically variable security devices may be between 2 and 8 microns thick. Such devices may be formed in accordance with our co-pending patent Australian Patent Application Nos. PF0384 and PF0386. To handle such devices, it is necessary that they be carried on a transfer foil, it being preferred in accordance with the present invention, to transfer these devices from the foil onto the substrate by a hot-stamping process. Also, it will be clear from the aforementioned co-pending patent application that the security devices need not be formed as discrete entities on the transfer foil but may, with advantage, be formed as a continuous optically variable coating on the foil, portions of which may be transferred onto the substrate at predetermined locations thereon.

Accordingly, the invention also includes apparatus for producing bank-notes and the like security tokens comprising:

means for feeding a printed sheet of polymeric substrate (of the type described) through the nip of a pair of rollers;

means for also feeding a transfer foil having a thin coating of optically variable material thereon through said nip together with said substrate so that said coating is adjacent to the substrate;

raised pads on the surface of one of said rollers adapted to be heated so that, when one of said pads is brought into contact with said foil (or with the substrate) portion of the coating is transferred to the substrate; and index means adapted to sense the position of the substrate and to delay or advance the rotation of said one roller so as to position said pads (and said coating portion) so that said pads press upon predetermined areas of the substrate to transfer said portions of the coating thereto.

In order to further portray the nature of the present invention, a particular embodiment thereof will now be described by way of example and illustration only. In the following description reference will be made to the accompanying drawings.

DETAILED DESCRIPTION OF ILLUSTRATED EMBODIMENTS

The particular embodiment of this invention concerns the production of bank-notes of high durability and security but which can be readily mass-produced. The bank-note of this particular embodiment is to have the appearance and feed of a conventional paper bank-note except that it includes a transparent portion or window within which an optically variable device such as a Moire grating or a diffraction grating is incorporated. In spite of the incorporation of this device, however, the note—at least superficially—is to appear to be of uniform thickness, to have no discontinuities, stiff inserts or the like. As previously indicated, the note basically comprises a transparent substrate having a pigmented coating, leaving the window onto the surface of which a very thin flexible optically variable device is hot-stamped. The entire note is then covered on each side with a thin, transparent protective polymeric coating adapted to resist dirt, grease and common solvents and to protect the exposed surface of the window and the exposed surface of the optically variable device.

Figure 1:
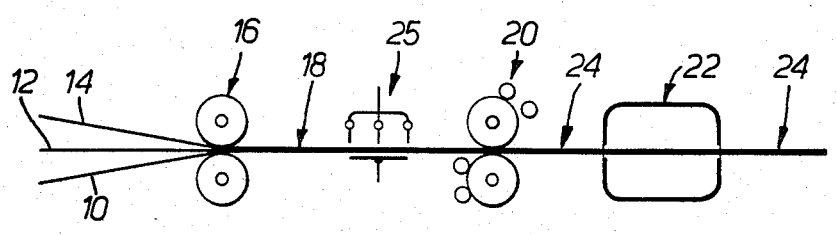
FIG. 1 is a diagrammatic representation of a laminating coating and drying process and apparatus suitable for the production of a bank-note substrate.
Figure 2:
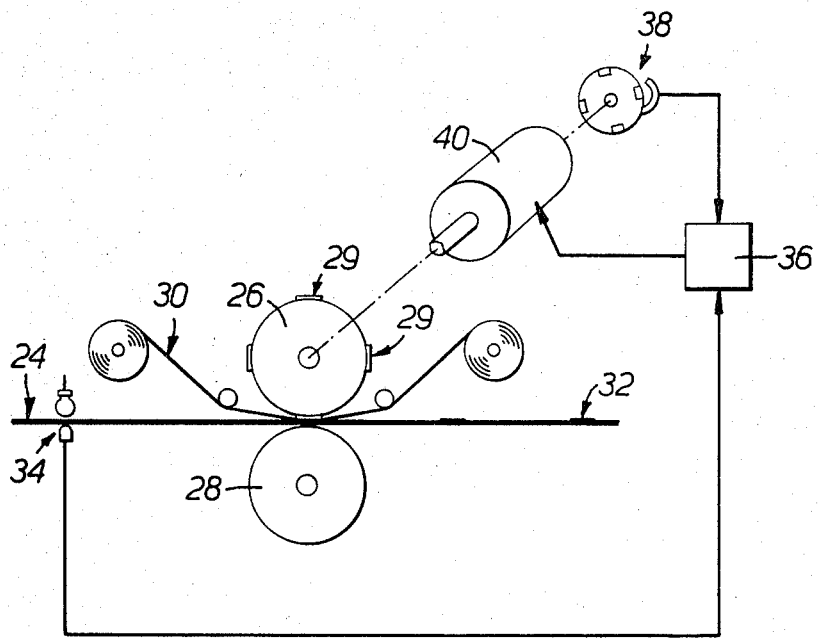
FIG. 2 is a diagrammatic representation of apparatus for transferring optically variable devices from a transfer foil onto the substrate of the particular embodiment.

Referring now particularly to FIG. 1 of the accompanying drawings, the production of the basic substrate material as a continuous strip or web is shown diagrammatically. The substrate illustrated consists basically of a laminate of three 24 micron sheets, 10, 12 and 14 of polymeric film on each side of which a thin coating of heat-activated polyolefin has been deposited. The three sheets are led together through a pair of heated callender rolls 16 so as to form them into an intimately bonded laminate 18. This laminate is led through a double set of printing rolls 20 which apply a uniform coating of a pale-coloured printing ink onto both surfaces of the laminate 18 to form the substrate 24, which is led through a drying oven 22 within which the coating is dried and cured.

Preferably, prior to the coating step, the laminate 18 is subjected to known surface treatment to improve the adhesion of the opacifying ink thereto. A suitable treatment may be the use of corona discharge, this being illustrated diagrammatically at 25 in FIG. 1. The treated laminate is coated with a pigmented coating comprising a pigment such as titanium dioxide dispersed within a binder or carrier of heat-activated cross-linkable polymeric material. In the coating of the substrate at station 20, a transparent window is left at intervals corresponding to each note within which the security device will be later inserted.

After the substrate has been produced as described in respect to FIG. 1, it is printed by the high quality presses normally employed in the production of bank-notes. Where sheet fed presses are employed, the substrate web may be cut into sheets for feeding, otherwise it can be fed directly into web fed presses.

After printing, the web or sheets are fed through an apparatus manufactured in accordance with the present invention wherein the optically variable devices are hot-stamped onto the window portion of the partially completed bank-notes. In this particular embodiment, the printed sheets or web 24 are fed between the nip of a pair of rollers 26 and 28 together with (and at the same speed as) a transfer foil 30. It would be usual for the sheet or web 24 to have a plurality of bank-notes printed across its width but, in that case, it can be readily arranged for the transparent windows of the notes in each row to be precisely aligned transversely across the sheet or web. Thus, a separate transfer foil 30 is provided for each note across the width of the sheet.

Figure 3:
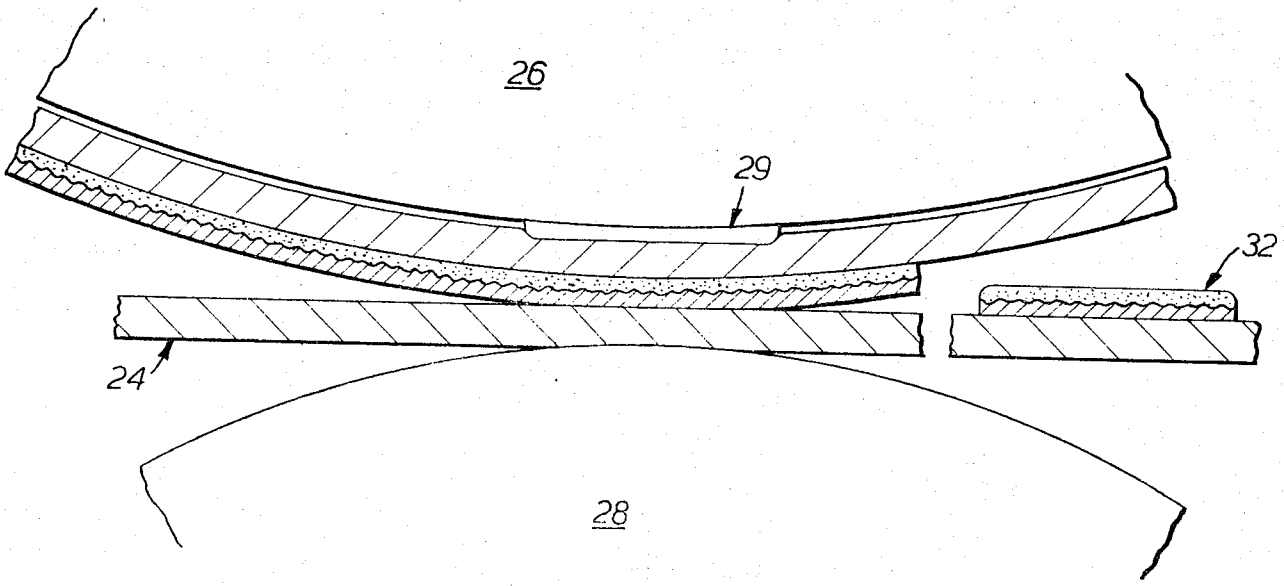
FIG. 3 is a detailed cross-sectional diagram showing the substrate and the transfer foil of FIG. 2 in more detail.

In accordance with the invention, upper roll 26 bears on its surface a series of raised pads 29 in line with each transfer foil 30, the pads 29 being spaced apart by a linear distance corresponding exactly with the longitudinal interval between the windows of the printed notes on sheet 24. Either the entire upper roll 26 or the individual raised pads 29 are heated so that as they rotate, they press the transfer foil firmly against the sheets 24 to effect the transfer of an optically variable device from the surface of the foil onto the sheet. Details of the transfer foil are provided in our above-mentioned copending application, but FIG. 3 provides illustration of this. In this example, the optically variable device 32 consists of a 3 to 5 micron layer of a soft thermoplastic material such as an acrylic copolymer into the surface of which a diffraction grating has been impressed and onto which surface a thin coating (less than 1 micron) of aluminium has been deposited to form the reflective diffraction grating. On this metallised surface, a further layer of an acrylic copolymer has been deposited as a heat-activated transfer medium which will facilitate the transfer and adhesion of the thin composite foil from the carrier and onto the substrate. To facilitate this transfer, the roller 28 is preferably cooled.

While transverse alignment of the notes printed on sheet 24 can be achieved by appropriate guides and accurate trimming of the sheets, longitudinal registration of the transfer devices within the window requires adjustment to compensate for stretch in a continuous web or slight variations in the pickup of separate sheets. For this purpose, in accordance with the present invention, a detector 34 is provided to detect a series of registration marks printed or otherwise formed on the edge of sheet 24, these marks bearing a constant positional relationship with the transparent windows of the printed notes. The output from detector 34 is transmitted to a comparator/controller 36 into which a signal is fed from a shaft-position encoder 38 connected to the shaft of roller 26, the comparator being adapted to produce a signal to indicate the degree of alignment or misalignment between pads 29 and the windows of the notes. This signal from the comparator can then be deployed to drive motor 40 to adjust the angular position of the roller 26 appropriately to maintain the desired alignment.

Finally, the printed note in sheet or roll form, bearing the optically variable devices, are then subjected to a further calendering or coating process (not illustrated) in which a thin coating of protective and transparent polymeric material is applied to both surfaces of the sheets, this coating serving the combined purpose of providing a soil and solvent resistent outer skin and of bonding the optically variable devices firmly in place and protecting their surfaces from mechanical damage. After this final coating operation, the completed bank-notes are separated by guillotining in the conventional fashion.

INDUSTRIAL APPLICABILITY

It will be appreciated by those skilled in the art that a durable, and secure bank-note, capable of mass production at economical cost by note issue authorities may be produced by the apparatus and process described in the particular embodiment given. However, many variations and modifications can be made to the system as described without departing from the scope of the present invention.

We claim:

1. A token comprising a flexible film substrate bearing identifying indicia and including an optically variable security device, characterised in that the substrate comprises a transparent bi-axially-oriented polymeric film composite having a heat-activated adhesive coating and an opacifying coating on at least one side, said substrate, indicia and the security device being covered with a transparent protective layer of polymeric material intimately heat-bonded to the substrate.

2. A token according to claim 1 further characterised in that the substrate itself comprises a laminate of two or more layers of transparent bi-axially-oriented polymer film each of which is coated on each side with a heat-activated adhesive layer.

3. A token according to claim 1, further characterised in that an opacifying coating is applied to both sides of the substrate and comprises a major proportion of pigment and a minor proportion of a cross-linked polymeric binder.

4. A token according to claim 1, further characterised in that:

(a) the substrate itself comprises a laminate of two or more layers of transparent bi-axially-oriented polymer film each of which is coated on each side with a heat-activated adhesive layer; and (b) an opacifying coating is applied to both sides of the substrate and comprises a major proportion of pigment and a minor proportion of a cross-linked polymeric binder.

5. A token according to claim 1, further characterised in that the opacifying coating is applied so as to leave an area of the substrate uncoated and transparent.

6. A token according to claim 2, further characterised in that the opacifying coating is applied so as to leave an area of the substrate uncoated and transparent.

7. A token according to claim 3, further characterised in that the opacifying coating is applied so as to leave an area of the substrate uncoated and transparent.

8. A token according to claim 4, further characterised in that the opacifying coating is applied so as to leave an area of the substrate uncoated and transparent.

9. A token according to claim 5, characterised in that the security device is heat-bonded to the substrate in said transparent area.

10. A token according to claim 6, characterised in that the security device is heat-bonded to the substrate in said transparent area.

11. A token according to claim 7, characterised in that the security device is heat-bonded to the substrate in said transparent area.

12. A token according to claim 8, characterised in that the security device is heat-bonded to the substrate in said transparent area.

* * * * *